US009280945B2

(12) United States Patent
Oh et al.

(10) Patent No.: US 9,280,945 B2
(45) Date of Patent: Mar. 8, 2016

(54) LIQUID CRYSTAL DISPLAY DEVICE AND METHOD OF DRIVING THE SAME

(71) Applicant: LG Display Co., Ltd., Seoul (KR)

(72) Inventors: Dae Seok Oh, Paju-si (KR); Bo Gun Seo, Paju-si (KR); Yong Hwa Park, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 167 days.

(21) Appl. No.: 14/025,484

(22) Filed: Sep. 12, 2013

(65) Prior Publication Data

US 2014/0071188 A1 Mar. 13, 2014

(30) Foreign Application Priority Data

Sep. 13, 2012 (KR) ..... 10-2012-0101794

(51) Int. Cl.
*G09G 5/10* (2006.01)
*G09G 3/36* (2006.01)

(52) U.S. Cl.
CPC ..... *G09G 3/3696* (2013.01); *G09G 3/3614* (2013.01); *G09G 3/3688* (2013.01); *G09G 3/3648* (2013.01); *G09G 2310/027* (2013.01); *G09G 2310/0248* (2013.01); *G09G 2330/023* (2013.01)

(58) Field of Classification Search
CPC . G09G 3/3614; G09G 3/3688; G09G 3/3685; G09G 2310/0248; G09G 2310/0251; G09G 2310/037; G09G 2330/021; G09G 3/3696; G09G 3/3648; G09G 2310/027; G09G 2330/023
USPC ..... 345/96, 98, 100, 87, 209
See application file for complete search history.

(56) References Cited

U.S. PATENT DOCUMENTS 6,914,587 B2 * 7/2005 Kosaka ..... 345/89
7,310,079 B2 * 12/2007 Chen et al. ..... 345/87
7,327,344 B2 * 2/2008 Asada et al. ..... 345/100
7,663,594 B2 * 2/2010 Do ..... G09G 3/3688 345/100

(Continued)

FOREIGN PATENT DOCUMENTS

CM 101320549 A 12/2008
CN 1744183 A 3/2006

(Continued)

OTHER PUBLICATIONS

State Intellectual Property Office of the People's Republic of China, Office Action, Chinese Patent Application No. 201310521302.9, Apr. 21, 2015, nine pages [with concise explanation of relevance in English].

*Primary Examiner* — Lun-Yi Lao
*Assistant Examiner* — Peter D McLoone
(74) *Attorney, Agent, or Firm* — Fenwick & West LLP

(57) ABSTRACT

An LCD device is disclosed which includes: a liquid crystal display panel in which there are a plurality of gate lines and a plurality of data lines; a data driver configured to apply data voltages to the data lines; a gate driver configured to apply gate pulses to the gate lines; and a charge share device configured to selectively perform a charge share operation by storing charges corresponding to a data voltage applied to one of the data lines during a first interval and providing the stored charges to said one or another one of the data lines during a second interval based on a comparison of first video data corresponding to said one of the data lines in the first interval with second video data corresponding to said one or another one of the data lines in the second interval.

22 Claims, 11 Drawing Sheets

(56) References Cited

U.S. PATENT DOCUMENTS

| | | | | |
|---|---|---|---|---|
| 7,884,653 | B2 * | 2/2011 | Chen et al. | 327/108 |
| 8,194,023 | B2 * | 6/2012 | Park | G09G 3/3614 345/89 |
| 8,456,464 | B2 * | 6/2013 | Hsu et al. | 345/212 |
| 8,605,067 | B2 * | 12/2013 | Chen et al. | 345/209 |
| 8,963,906 | B2 * | 2/2015 | Oh | 345/211 |
| 9,082,363 | B2 * | 7/2015 | Chang | G09G 3/3685 |
| 9,093,039 | B2 * | 7/2015 | Oh | G09G 3/3614 |
| 2002/0105492 | A1 * | 8/2002 | Kosaka | 345/89 |
| 2004/0178981 | A1 * | 9/2004 | Asada et al. | 345/96 |
| 2006/0001630 | A1 * | 1/2006 | Chen et al. | 345/96 |
| 2006/0262069 | A1 * | 11/2006 | Do | G09G 3/3688 345/98 |
| 2008/0204386 | A1 * | 8/2008 | Park | G09G 3/3614 345/84 |
| 2008/0278467 | A1 * | 11/2008 | Hwang et al. | 345/205 |
| 2009/0015297 | A1 * | 1/2009 | Chen et al. | 327/108 |
| 2009/0207118 | A1 * | 8/2009 | Lee et al. | 345/98 |
| 2010/0149171 | A1 * | 6/2010 | Huang et al. | 345/214 |
| 2010/0188389 | A1 * | 7/2010 | Hsu et al. | 345/212 |
| 2011/0069088 | A1 | 3/2011 | Weng et al. | |
| 2012/0154358 | A1 * | 6/2012 | Chen et al. | 345/209 |
| 2013/0083093 | A1 * | 4/2013 | Kim | 345/690 |
| 2013/0120349 | A1 * | 5/2013 | Oh | 345/212 |
| 2014/0104260 | A1 * | 4/2014 | Chang | G09G 3/3685 345/212 |
| 2014/0160186 | A1 * | 6/2014 | Oh et al. | 345/694 |
| 2014/0210804 | A1 * | 7/2014 | Liao et al. | 345/209 |
| 2015/0022238 | A1 * | 1/2015 | Choi | 326/80 |

FOREIGN PATENT DOCUMENTS

| | | | |
|---|---|---|---|
| CN | 102157136 | A | 8/2011 |
| TW | I307077 | B | 3/2009 |

* cited by examiner

LIQUID CRYSTAL DISPLAY DEVICE AND METHOD OF DRIVING THE SAME

The present application claims priority under 35 U.S.C. §119(a) of Korean Patent Application No. 10-2012-0101794 filed on Sep. 13, 2012, which is hereby incorporated by reference in its entirety.

BACKGROUND

1. Field of the Disclosure

The present application relates to a liquid crystal display device and a method of driving the liquid crystal display device.

2. Description of the Related Art

As the information society spreads, the requirements for display devices are varied and gradually increasing. In accordance therewith, a variety of display devices such as liquid crystal display (LCD) devices, plasma display panels (PDP), electro-luminescent display (ELD) devices, vacuum fluorescent display (VFD) devices, and so on, have been researched. Furthermore, some display devices already have been put into practice in many appliances.

More specifically, the LCD devices are rapidly replacing cathode ray tubes (CRTs) and are used most often as a portable image (or picture) display device, because they have features such as superior picture quality, light weight, slimness, and low power consumption. These LCD devices are being developed in a variety of shapes and form factors that are utilized in computer monitors, portable electronic devices such as smartphones and tablets, television display screens, and so on, as well as portable notebook computer monitors.

A typical LCD device includes an LCD panel and a data driver. The LCD panel includes a plurality of gate lines and a plurality of data line crossing each other. The data driver is used to apply data voltages to the data lines.

FIG. 1 is a circuit diagram showing a part of a data driver, data lines and pixel regions of an LCD device according to the related art.

Referring in detail to FIG. 1, a data driver of the related art LCD device includes: a positive polarity digital-to-analog converter (hereinafter, 'PDAC') PDAC that converts a digital signal into a positive data voltage; a negative polarity digital-to-analog converter (hereinafter, 'NDAC') NDAC that converts the digital signal into a negative data voltage; a positive polarity buffer PAMP buffering the positive data voltage; and a negative polarity buffer NAMP buffering the negative data voltage.

The positive data voltage output from the positive polarity buffer PAMP can be transferred to first and second data lines DL1 and DL2 via first and second transistors TR1 and TR2. The negative data voltage output from the negative polarity buffer NAMP can be transferred to the first and second data lines DL1 and DL2 via third and fourth transistors TR3 and TR4.

A first resistor Rp and a first capacitor Cp correspond to an equivalent resistance and an equivalent capacitance of plural pixel regions which are connected to the first data line DL1. A second resistor Rn and a second capacitor Cn correspond to an equivalent resistance and an equivalent capacitance of plural pixel regions which are connected to the second data line DL2.

A switch element SW can be connected between the first and second data lines DL1 and DL2. The switch element SW can be turned-on/off by a control signal. When the switch element SW is turned-on, a charge share operation enabling electric charges to be shared by the first and second data lines DL1 and DL2 can be performed. The switch element SW is turned-on in a high interval of a source output enable signal SOE, thereby allowing the charge share operation to be performed. In other words, the charge share operation is performed in the high level interval of the source output enable signal SOE. As such, the charge share operation enables the data voltages with the same polarity to be applied during at least two horizontal intervals. In accordance therewith, the charge share operation must be performed in a non-desired interval. Due to this, the related LCD device increases power consumption and heat generation.

The positive and negative polarity buffers PAMP and NAMP can each have a single ended configuration. The positive polarity buffer PAMP can include a first positive polarity logic circuit P1, a second positive polarity logic circuit P2, a first positive polarity transistor PTR1 and a second positive polarity transistor PTR2. The negative polarity buffer NAMP can include a first negative polarity logic circuit N1, a second negative polarity logic circuit N2, a first negative polarity transistor NTR1 and a second negative polarity transistor NTR1.

The first positive polarity logic circuit P1 and the second positive polarity logic circuit P2 are defined by dividing the internal configuration of the positive polarity buffer PAMP according to a current share mode. The first negative polarity logic circuit N1 and the second negative polarity logic circuit N2 are defined by dividing the internal configuration of the negative polarity buffer NAMP according to the current share mode.

The first positive polarity logic circuit P1 and the first negative polarity logic circuit N1 can be connected between a supply voltage line VDD and a ground voltage line GND. The second positive polarity logic circuit P2 can be connected between the supply voltage line VDD and a bias voltage line HVDD. The second negative polarity logic circuit N2 can be connected between the bias voltage line HVDD and the ground voltage line GND. The second positive and negative polarity logic circuits P2 and N2 can share a current, which flows from the supply voltage line VDD to the ground voltage line GND via the bias voltage line HVDD, with each other. However, the first positive and negative polarity logic circuits P1 and N1 connected in parallel between the supply voltage line VDD and the ground voltage line GND cannot share a current with each other. Due to this, consumption power cannot be reduced and heat generated in the data driver must increase.

BRIEF SUMMARY

Accordingly, embodiments of the present application are directed to a liquid crystal display device and a driving method thereof that substantially obviate one or more of problems due to the limitations and disadvantages of the related art.

The embodiments are to provide an LCD device and a driving method thereof that are adapted to reduce power consumption and heat generated in a data driver.

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

According to a first general aspect of the present embodiment, an LCD device includes: a liquid crystal display panel including a plurality of gate lines and a plurality of data lines;

a data driver configured to apply data voltages to the data lines; a gate driver configured to apply gate pulses to the gate lines; and a charge share device configured to selectively perform a charge share operation by storing charges corresponding to a data voltage applied to one of the data lines during a first interval and providing the stored charges to said one or another one of the data lines during a second interval based on a comparison of first video data corresponding to said one of the data lines in the first interval with second video data corresponding to said one or another one of the data lines in the second interval.

An LCD device driving method according to a second general aspect of the present embodiment includes: storing charges corresponding to a data voltage applied to one of the data lines during a first interval; detecting a number of digital pixel signals which are opposite to one of odd and even numbered digital pixel signals of first video data and have differences of at least first reference gray level in comparison with corresponding digital pixel signals of second video data during a second interval; and determining whether to perform a charge share operation based at least in part on the detected number of digital pixel signals exceeding a threshold value, the charge share operation performed by providing the stored charges to said one or another one of the data lines during the second interval.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated herein and constitute a part of this application, illustrate embodiment(s) of the present disclosure and together with the description serve to explain the disclosure. In the drawings.

DETAILED DESCRIPTION OF THE EMBODIMENTS

Figure 1:
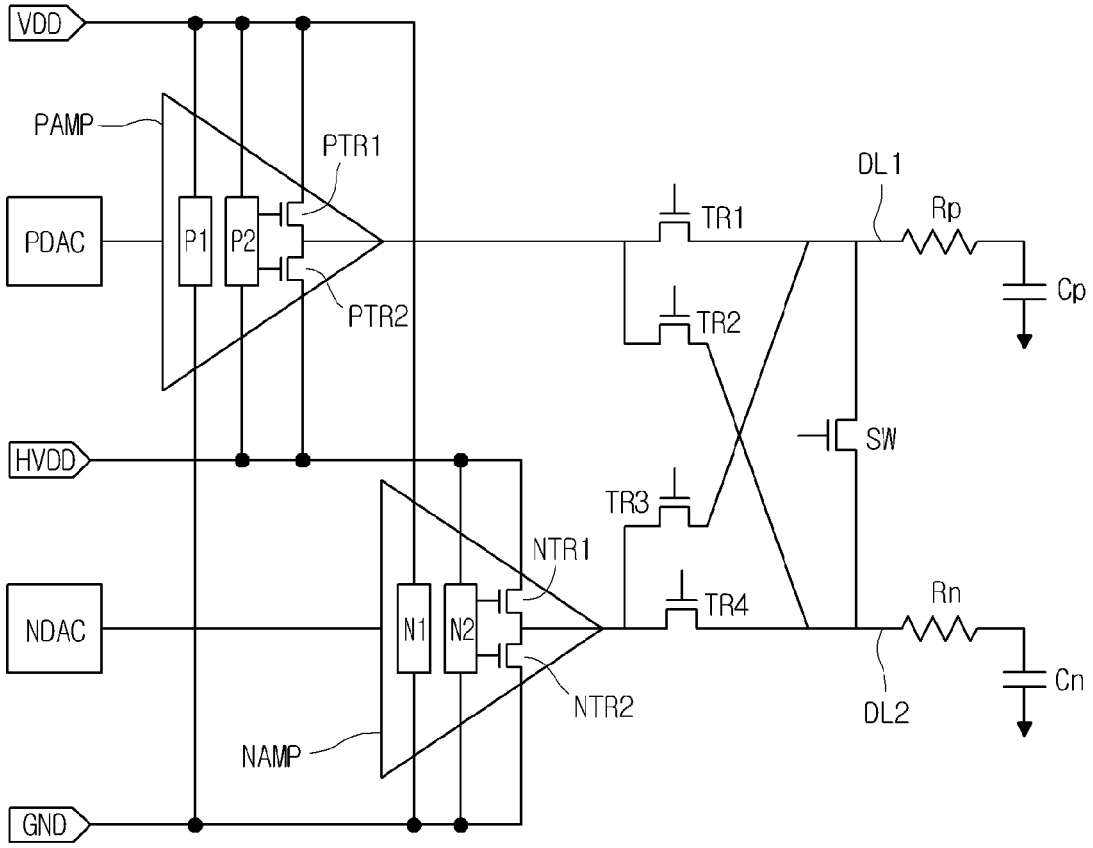
FIG. 1 is a circuit diagram showing a part of a data driver, data lines and pixel regions of an LCD device according to the related art.

In the present disclosure, it will be understood that when an element, such as a substrate, a layer, a region, a film, or an electrode, is referred to as being formed "on" or "under" another element in the embodiments, it may be directly on or under the other element, or intervening elements (indirectly) may be present. The term "on" or "under" of an element will be determined based on the drawings. Reference will now be made in detail to the present embodiments, examples of which are illustrated in the accompanying drawings. In the drawings, the sizes and thicknesses of elements can be exaggerated, omitted or simplified for clarity and convenience of explanation, but they do not mean the practical sizes of elements.

An LCD device can include: a liquid crystal display panel including a plurality of gate lines and a plurality of data lines; a data driver configured to apply data voltages to the data lines; a gate driver configured to apply gate pulses to the gate lines; and a charge share device configured to selectively perform a charge share operation by storing charges corresponding to a data voltage applied to one of the data lines during a first interval and providing the stored charges to said one or another one of the data lines during a second interval based on a comparison of first video data corresponding to said one of the data lines in the first interval with second video data corresponding to said one or another one of the data lines in the second interval.

The charge share device may include: a positive charge sharer configured to perform the charge share operation for odd-numbered data lines; and a negative charge sharer configured to perform the charge share operation for even-numbered data lines.

The positive charge sharer and the negative charge sharer each may include a charge capacitor to store charges, and the charge share operation may be performed using a bias voltage charged in the charge capacitor.

The charge capacitor charges to the bias voltage during the first interval at which the data voltages are applied to the data lines, and the charge share operation can be performed during the second interval at which the data voltages are not applied to the data lines.

The bias voltage may be a reference voltage corresponding to a gray level 0.

The charge share device may further include: a line memory configured to store the first video data during the first interval; and a determiner configured to compare the second video data with the first video data from the line memory and determine whether to perform the charge share operation.

The determiner detects a number of digital pixel signals of the first video data which have differences of at least first reference gray level in comparison with digital pixel signals of the second video data, in order to determine whether to perform the charge share operation.

The determiner may calculate an average gray level of the first video data and determine whether to perform the charge share operation on the basis of the average gray level of the first video data if the detected number of digital pixel signals of the first video data is not more than a reference value.

The determiner can generate a first charge share signal used to control the positive charge sharer, and a second charge share signal used to control the negative charge sharer.

The data driver can include; a digital-to-analog converter configured to convert video data into the data voltages; and a buffer portion formed in a rail-to-rail configuration and configured to output the data voltages from the digital-to-analog converter to the data lines.

The liquid crystal display panel may be driven in a double race driving mode. An LCD device driving method according to an embodiment of the present disclosure can include: storing charges corresponding to a data voltage applied to one of the data lines during a first interval; detecting a number of digital pixel signals which are opposite to one of odd and even numbered digital pixel signals of first video data and have differences of at least first reference gray level in comparison with corresponding digital pixel signals of second video data during a second interval; and determining whether to perform a charge share operation based at least in part on the detected number of digital pixel signals exceeding a threshold value, the charge share operation performed by providing the stored charges to said one or another one of the data lines during the second interval.

The LCD device driving method can further include outputting a charge share signal when one of odd and even numbered digital pixel signals of the first video data is entirely no less than the corresponding digital pixel signals of the second video data.

The LCD device driving method can further include comparing an average gray level of the first video data with a second reference gray level when the detected number of digital pixel signals corresponds to 1.

The LCD device driving method can further include outputting a charge share signal when the average gray level of the first video data is less than the second reference gray level.

The LCD device driving method can further include comparing an average gray level of the first video data with a third reference gray level when the detected number of digital pixel signals corresponds to at least 2.

The LCD device driving method can further include outputting a charge share signal when the average gray level of the first video data is less than the third reference gray level.

The first reference gray level can become a middle gray level.

The second reference gray level can be between a maximum gray level and the first reference gray level.

The first and third reference gray levels can be substantially the same.

Figure 2:
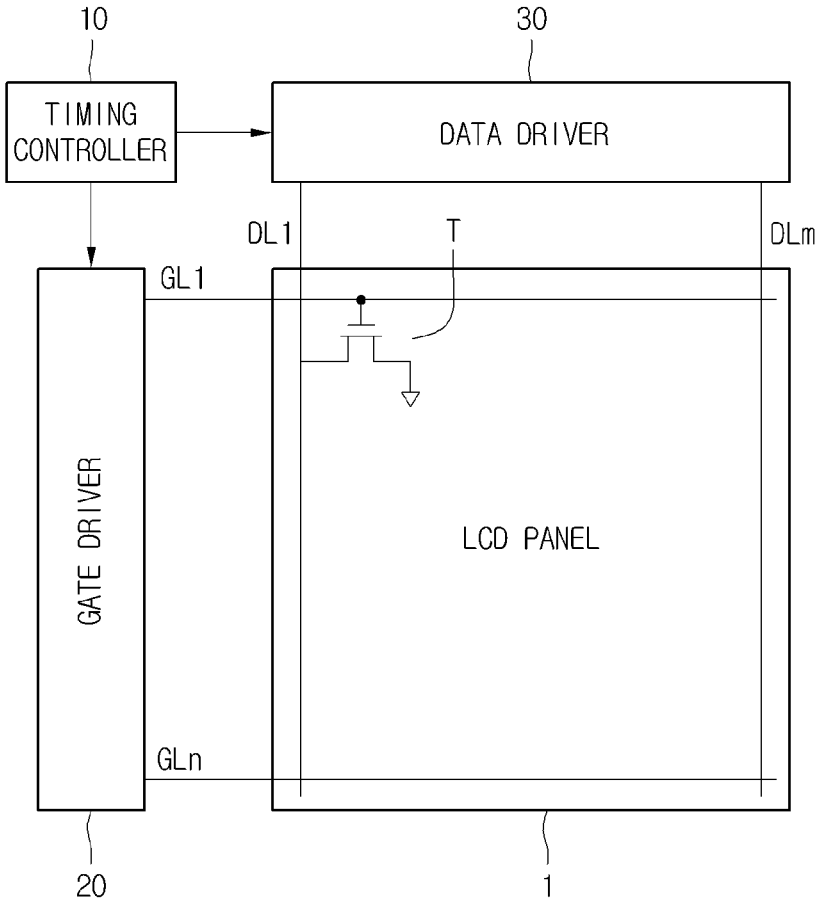
FIG. 2 is a block diagram showing an LCD device according to an embodiment of the present disclosure.

FIG. 2 is a block diagram showing an LCD device according to an embodiment of the present disclosure.

Referring to FIG. 2, the LCD device according to an embodiment of the present disclosure can include an LCD panel 1, a timing controller 10, a gate driver 20 and a data driver 30.

The LCD panel 1 can include a plurality of gate lines GL1~GLn and a plurality of data lines DL1~DLm extended in a direction perpendicular to the gate lines GL1~GLn. A plurality of pixel regions can be defined by the plurality of gate lines GL1~GLn and the plurality of data lines DL1~DLm. A thin film transistor T can be formed on each of the pixel regions. The thin film transistor T can be electrically connected to one of the gate lines GL1~GLn and one of the data lines DL1~DLn. The LCD panel 1 may be driven in a multiple inversion mode by the data driver 30. Also, the LCD panel 1 may have an arrangement of pixel regions which is adapted to be driven in the multiple inversion modes. For example, the LCD panel 1 may be driven in a double rate driving mode, but the present embodiment is not limited to this.

The thin film transistor T can be turned-on by a gate signal which is applied from one of the gate lines GL1~GLn. The turned-on thin film transistor T can transfer a data voltage applied from one of the data lines DL1~DLm to a pixel electrode (not shown). The data voltage applied to the pixel electrode and a common voltage on a common electrode (not shown) can form an electric field. The electric field can force liquid crystal molecules of a liquid crystal cell (not shown) to be realigned. As such, light being generated in a backlight unit and passing through the liquid crystal cell can be adjusted in quantity. In accordance therewith, in image can be displayed on the LCD panel 1.

The timing controller 10 can receive video data RGB, a horizontal synchronous signal H, a vertical synchronous signal V and a clock signal CLK from the exterior. Also, the timing controller 10 can derive gate control signals GDC and data control DDC from the horizontal synchronous signal H, the vertical synchronous signal V and the clock signal CLK. The gate control signals GDC can be used to control the gate driver 20. The data control signals can be used to control the data driver 30.

The gate driver 20 may include a shift register, a level shifter and an output buffer which are not shown in the drawings. The shift register replies to the gate control signals GDC and sequentially generates scan pulses. The level shifter enables the scan pulses to be level-shifted to a voltage level suitable for driving the liquid crystal cell. As such, the swing width of the scan pulse can be widened. The output buffer can allow the level-shifted scan pulses to be buffered and output to the gate lines GL1~GLn as gate signals. Such a gate driver 30 can sequentially select the liquid crystal cells in a single horizontal line (or one line) of liquid crystal cells, which receive a single line of data voltages, by applying the sequentially enabled gate signals to the gate lines GL1~GLn and turning-on the thin film transistors connected to the gate lines GL1~GLn in one line. In accordance therewith, the single line of data voltages generated in the data driver 30 can be applied to the liquid crystal cells connected to one of the gate lines GL1~GLn which is selected by the enabled gate signal.

The data driver 30 can sample and latch the video data RGB applied from the timing controller 10. Also, the data driver 30 can convert the latched video data into analog data voltages. Such a data driver 30 will be described in detail later.

The gate driver 20 and the data driver 30 can each include a plurality of integrated circuit (IC) chips.

Figure 3:
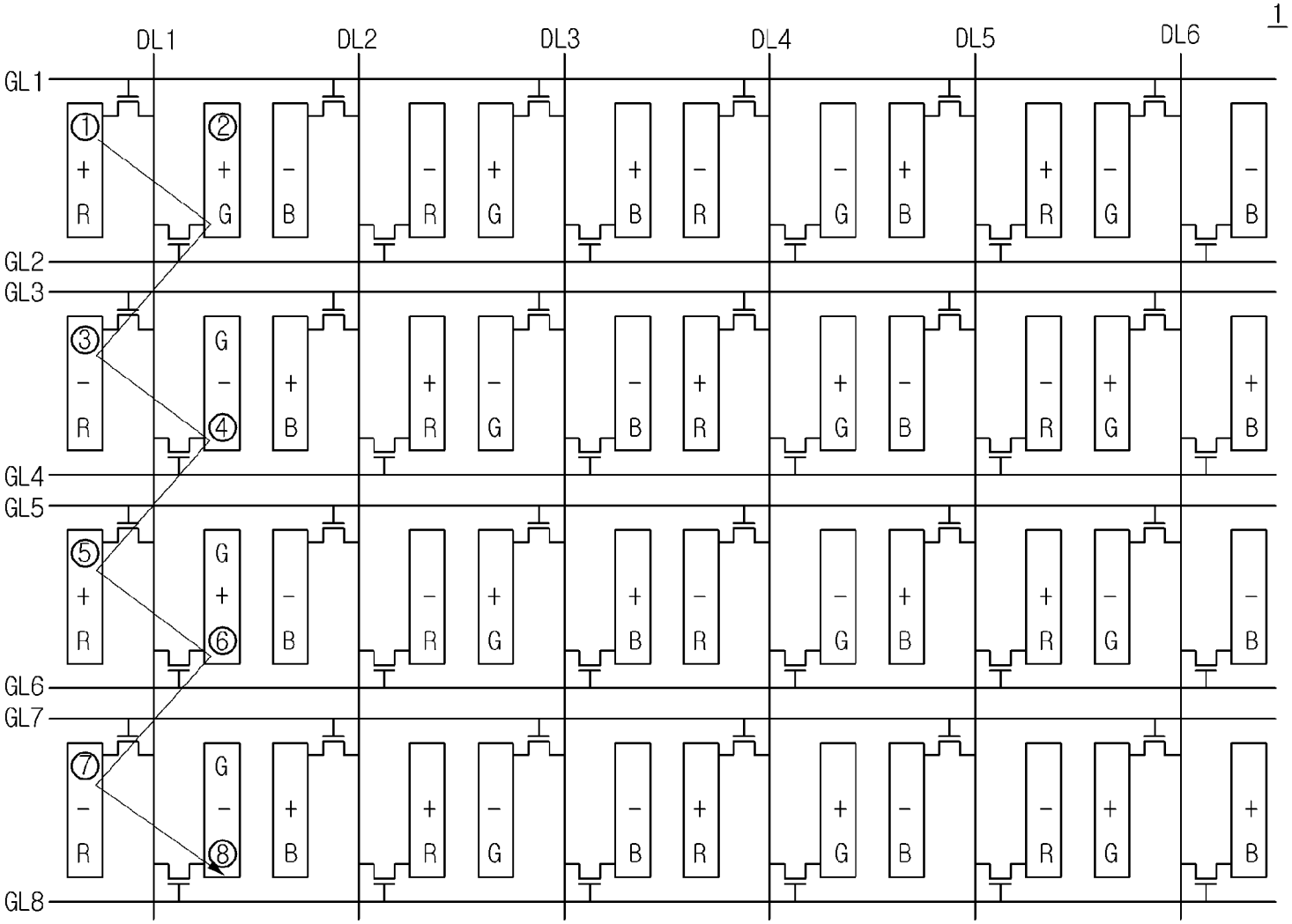
FIG. 3 is a planar view showing a pixel arrangement of a DRD drive mode LCD panel which is shown in FIG. 2.

FIG. 3 is a planar view showing a pixel arrangement of a DRD drive mode LCD panel which is shown in FIG. 2.

As shown in FIG. 3, the LCD panel 1 of the present embodiment allows a plurality of liquid crystal cells disposed on a single horizontal line to be driven by a single data line and a pair of gate lines. Also, the LCD panel 1 can be driven in a two-dot inversion mode. As such, the LCD panel 1 can minimize flicker generation and reduce power consumption. In other words, two liquid crystal cells adjacent to each other with having a single data line therebetween can be coupled to two gate lines and sequentially receive the data voltages with the same polarity.

The liquid crystal cells can be sequentially charged with the data voltages in a zigzag shape progressing along an arrow line. For example, among the liquid crystal cells coupled to the first and second gate lines GL1 and GL2, red and green liquid crystal cells coupled to the first data line DL1 can be sequentially charged with the positive data voltages, and the blue and red liquid crystal cells coupled to the second data line DL2 can be sequentially charged with the negative data voltages.

The pixel arrangement in accordance with the DRD mode can be explained by the liquid crystal cells coupled to six data lines DL1~DL6. In this case, among 12 liquid crystal cells arranged on a first horizontal line, six liquid crystal cells including red, green and blue cells in twos can be charged with the positive data voltages, but the other six liquid crystal cells including red, green and blue cells in twos can be charged with the negative data voltages. In accordance therewith, the LCD panel 1 including the liquid crystal cells connected to six data lines DL1~DL6 can be driven without being biased toward one of the polarities and disproportionating red, green and blue colors.

Figure 4:
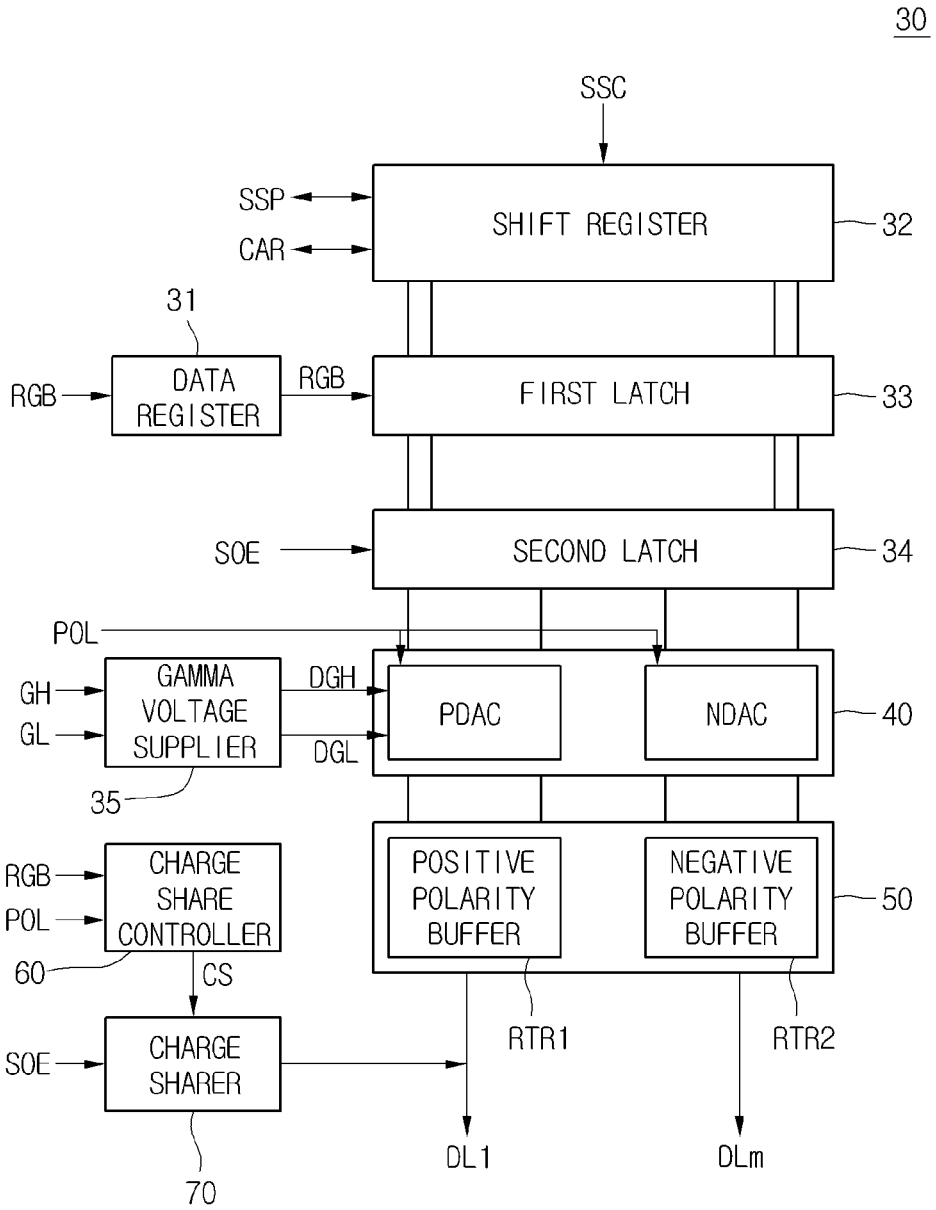
FIG. 4 is a detailed block diagram showing a data driver which is shown in FIG. 2.

FIG. 4 is a detailed block diagram showing a data driver which is shown in FIG. 2.

Referring to FIG. 4, the data driver 30 of the LCD device according to the present embodiment may include a data register 31, a shift register 32, first and second latches 33 and 34, a gamma voltage supplier 35, a DAC 40, a buffer portion 50, a charge share controller 60 and a charge sharer 70.

The data register 31 receives digital data RGB applied from the timing controller 10 and transfers the received digital data RGB to the first latch 33. The shift register 32 shifts a source start pulse SSP from the timing controller 10 according to a source sampling clock signal SSC and generates sampling signals being sequentially enabled. Also, the shift register 32 may apply a carry signal CAR which is generated by shifting the source start pulse SSP, to the following shift register (not shown). The first latch 33 replies to the sequentially enabled sampling signals and sequentially samples the digital data RGB applied from the data register 31. The second latch 34 latches the digital data applied from the first latch 33 and outputs the latched digital data RGB to the DAC 40, in response to a source output enable signal SOE from the timing controller 10. The DAC 40 converts the digital data RGB into the data voltages using gamma voltages DGH and DGL and applies the converted data voltages to the buffer portion 50.

The DAC 40 can include a positive polarity DAC PDAC and a negative polarity DAC NDAC. The positive polarity DAC PDAC can generate positive data voltages and transfer the positive data voltages to the buffer portion 50, in response to a polarity signal POL with a high level. The negative polarity DAC NDAC can generate negative data voltages and transfer the negative data voltages to the buffer portion 50, in response to the polarity signal POL with a low level. In other words, the positive polarity DAC PDAC can transfer the positive data voltages to a positive polarity buffer RTR1, and the negative polarity DAC NDAC can transfer the negative data voltages to a negative polarity buffer RTR2.

The buffer portion 50 can transfer the data voltages applied from the DAC 40 to the plurality of data lines DL1~DLm. Such a buffer portion 50 can include the positive polarity buffer RTR1 and the negative polarity buffer RTR2.

FIG. 4 also illustrates a charge share device including a charge share controller 60 and charge sharer 70. The charge share device receives the digital data RGB, polarity signal POL, and source output enable signal SOE from the timing controller 10.

The charge share controller 60 can derive a charge share signal CS from the video data RGB and the polarity signal POL, which are applied from the timing controller 10. The charge share signal CS can be transferred from the charge share controller 60 to the charge sharer 70. More specifically, the charge share controller 60 can generate the charge share signal CS by analyzing gray level variation of the video data RGB according to the polarity signal POL. Such a charge share controller 60 of the charge share device will be described in detail later.

The charge sharer 70 can perform a charge share operation for the plurality of data lines DL1~DLm in response to the charge share signal CS applied from the charge share controller 60 and the source output enable signal SOE applied from the timing controller 10. This charge sharer 70 of the charge share device will be described in detail later.

Figure 5:
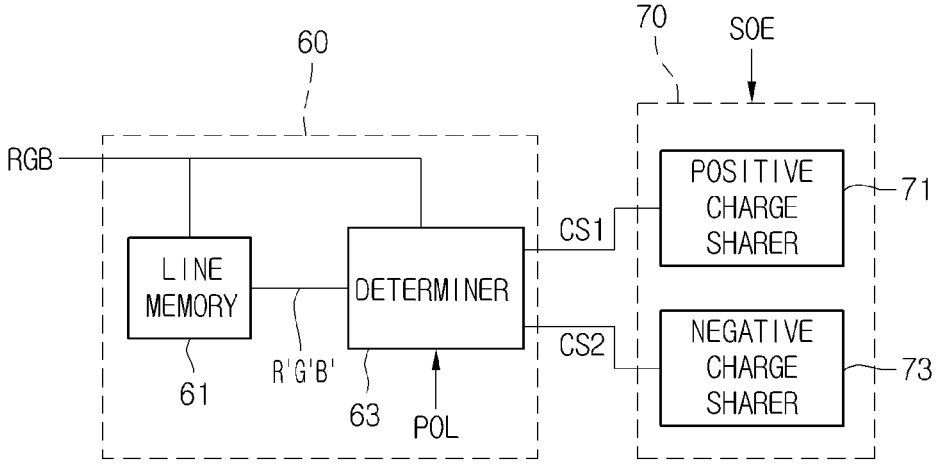
FIG. 5 is a detailed block diagram of a charge share device showing a charge share controller and a charge sharer which are shown in FIG. 4.

FIG. 5 is a detailed block diagram of a charge share device including a charge share controller and a charge sharer which are shown in FIG. 4.

Referring to FIG. 5, the charge share controller 60 of the LCD device according to the present embodiment may include a line memory 61 and a determiner 63. Also, the charge sharer 70 can include a positive charge sharer 71 and a negative charge sharer 73.

The charge share controller 60 can receive the video data RGB and the polarity signal POL from the timing controller 10 and apply the charge share signal CS to the charge sharer 70. In other words, the charge share controller 60 determines when a charge share operation of the charge sharer 70 should be performed, and selectively generates the charge share signal CS according to the determined resultant, and applies the charge share signal CS to the charge sharer 70.

The charge share signal CS generated in the charge share controller 60 may include first and second charge share signals CS1 and CS2 applied, respectively, to positive and negative charge sharers 71, 73. Thus, the first charge share signal CS1 can be transferred from the charge share controller 60 to the positive charge sharer 71 of the charge sharer 70 to perform a positive charge share operation. The second charge share signal CS2 can be transferred from the charge share controller 60 to the negative charge sharer 73 to perform a negative charge share operation.

The line memory 61 can store the video signal data RGB, which is applied from the timing controller 10, for example, during a single horizontal synchronous interval. Also, the line memory 61 can apply the stored video data RGB to the determiner 63 after the single horizontal synchronous interval. In other words, the line memory 61 can delay the video data RGB which may be applied from the timing controller 10 to the determiner 63 in a subsequent interval. As such, present video data RGB from the timing controller 10 and the previous video data R'G'B' from the line memory 61 can be simultaneously applied to the determiner 63. The present video data RGB can include digital pixel signals which will be displayed on a kth horizontal line, the previous video data R'G'B' can include digital pixel signals which will be displayed on a (k-1)th horizontal line.

The determiner 63 generates the first and second charge share signals CS1 and CS2 based on the present video signal RGB and the polarity signal POL, which are applied from the timing controller 10, and the previous video signal R'G'B' applied from the line memory 61. The first and second charge share signals CS1 and CS2 can be applied to the charge sharer 70. More specifically, the determiner 63 can determine whether to perform the charge share operation according to the polarity signal POL and the number of digital pixel signals of the previous video data R'G'B' which have different gray levels from the digital pixel signals of the present video data RGB. Also, the determiner 63 can generate the charge share signal CS in accordance with the determined resultant. The charge share signal CS can be synchronized with the source output enable signal SOE. The determining process performed by the determiner 63 will be described in detail referring to FIG. 6, later.

The charge sharer 70 can perform the charge share operation for the plurality of data lines DL1~DLm in response to the source output enable signal SOE from the timing controller 10 and the first and second charge share signals CS1 and CS2 from the determiner 63. The positive charge sharer 71 may perform the charge share operation for a first plurality of data lines and the negative charge sharer 73 may perform the charge share operation for a second plurality of data lines. The first plurality of data lines may alternate with the second plurality of data lines. Further, either charge sharer 71, 73 may be coupled to an adjacent data line to perform the charge operation through the operation of transistor switches coupling adjacent data lines, for example those illustrated in more detail with reference to FIG. 7.

For an example set of 100 data lines, if the first charge share signal CS1 has a high level, the charge share operation can be performed for the odd-numbered data lines (i.e., 1, 3, 5, etc.). When the second charge share signal CS2 has the high level, the charge share operation can be performed for the even-numbered data lines (i.e., 2, 4, 6, etc.).

However, the present embodiment is not limited to the above example. For example, through the use of transistor switches selectively coupling two adjacent data lines, the positive charge sharer 71 may additionally perform the charge share operation for the even-numbered data lines, or the negative charge sharer 73 may additionally perform the charge share operation for the odd-numbered data lines.

Figure 6:
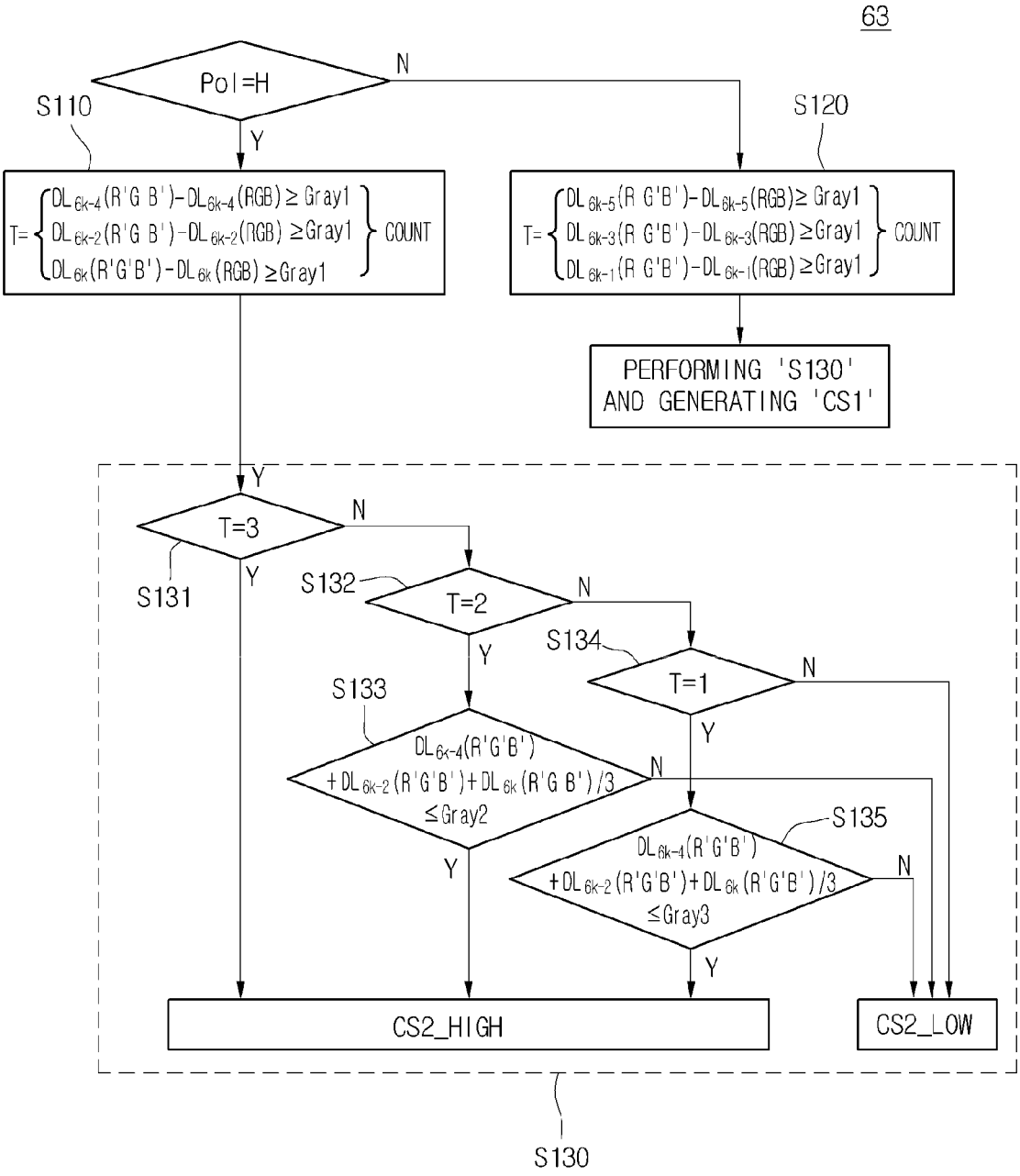
FIG. 6 is a flow chart illustrating a charge share determination process which is performed by a determiner of FIG. 5.

FIG. 6 is a flow chart illustrating a charge share determination process which is performed by a determiner of FIG. 5.

Referring to FIGS. 3 and 6, the charge share determination process performed by the determiner 63 of the LCD device according to the present embodiment can be defined into a positive polarity mode and a negative polarity mode according to the logic state of the polarity signal POL.

When the polarity signal POL has the high level, the number T of even-numbered digital pixel signals, which correspond to the digital pixel signals of the previous video data R'G'B' opposite to even-numbered data lines DLk-4, DLk-2 and DLk and have differences of at least first reference gray level Gray1 compared to the present digital pixel signals of the present video data RGB opposite to the even-numbered data lines DLk-4, DLk-2 and DLk, is detected by the determiner 63 (Step S110).

Meanwhile, if the polarity signal POL has the low level, the number T of odd-numbered digital pixel signals, which correspond to the digital pixel signals of the previous video data R'G'B' opposite to odd-numbered data lines DLk-5, DLk-3 and DLk-1 and have differences of at least first reference gray level Gray1 compared to the present digital pixel signals of the present video data RGB opposite to the odd-numbered data lines DLk-5, DLk-3 and DLk-1, is detected by the determiner 63 (Step S120).

The first reference gray level Gray1 may be a middle gray level. For example, the first reference gray level Gray1 can become a gray level 127.

For example, the previous video data R'G'B' including the even-numbered digital pixel signals with gray levels 255, 200 and 170 and the present video data RGB including the even-numbered digital pixel signals with gray levels 50, 10 and 100 can be input to the determiner 63. In this case, the number T of previous even-numbered digital pixel signals R'G'B' having differences of at least first reference gray level Gray1 in comparison with the present even-numbered digital pixel signals RGB can be 'two'. As such, the determiner 63 can generate the first charge share signal with the high level and enable the charge share operation to be performed for the even-numbered data lines.

In this manner, the charge share operation can be performed for the data lines DL1~DL2 only when the gray level difference between the previous video data R'G'B' and the present video data RGB becomes larger. Therefore, power consumption of the LCD device can be reduced and heat generated in the data driver 30 can be minimized.

As shown in FIG. 3, negative data voltages can be applied to not only liquid crystal cells which are connected to the even-numbered data lines DL2, DL4 and DL6 and arranged on a first horizontal line, but also other liquid crystal cells which are connected to the odd-numbered data lines DL1, DL3 and DL5 and arranged on a second horizontal line. Also, only a part of the video data RGB opposite to the even-numbered data lines (i.e., the negative data voltages) can be used in the comparison process during the high level interval of the polarity signal POL. During the low level interval of the polarity signal POL, only the other part of the video data RGB opposite to the odd-numbered data lines (i.e., positive data voltages) may be used in the comparison process. As such, the determiner 63 may use only a part of the video data RGB opposite to the negative data voltages (i.e., the even-numbered data lines) in order to determine whether it is or not necessary to perform the charge share operation for the first horizontal line. In accordance therewith, the determination process performed by the determiner 63 can be simplified. Although the determination process of the negative polarity mode is described as an example, the determination process of the positive polarity mode can be performed in the same as the above-mentioned procedure, in order to determine whether it is or not necessary for the charge share operation.

A step S130 of determining whether the charge share operation may be performed after the steps S110 and S120 of detecting the number T of digital pixel signals of the previous video data R'G'B' which have differences of at least first reference gray level Gray1 in comparison with those of the present video data RGB.

In the step S130 of determining whether or not to perform the charge share operation, the determiner 63 can output the second charge share signal CS2 with the high level when the number of even-numbered digital pixel signals of the previous video data R'G'B' which have differences of at least first reference gray level Gray1 in comparison with those of the present video data RGB (Sub-step S131).

When the number T of even-numbered digital pixel signals of the previous video data R'G'B', which have differences of at least first reference gray level Gray1 in comparison with those of the present video data RGB (Sub-step S131) , is two (Sub-step S132), the determiner 63 calculates an average gray level of the previous video data R'G'B' and compares the average gray level with a second reference gray level Gray2 (Sub-step S133). If the average gray level of the previous video data R'G'B' is less than the second reference gray level Gray2, the determiner 63 may output the second charge share signal CS2 with the high level. On the contrary, when the average gray level of the previous video data R'G'B' is not less than the second reference gray level Gray2, the determiner 63 can output the second charge share signal CS2 with the low level. The second reference gray level Gray2 can be a gray level between the first reference gray level Gray1 and a maximum gray level. For example, the second reference gray level Gray2 can become a gray level 191.

If the number T of even-numbered digital pixel signals of the previous video data R'G'B', which have differences of at least first reference gray level Gray1 in comparison with those of the present video data RGB (Sub-step S131) , is one (Sub-step S134), the determiner 63 calculates the average gray level of the previous video data R'G'B' and compares the average gray level with a third reference gray level Gray3 (Sub-step S135). When the average gray level of the previous video data R'G'B' is less than the third reference gray level Gray3, the determiner 63 can output the second charge share signal CS2 with the high level. On the contrary, when the average gray level of the previous video data R'G'B' is not less than the third reference gray level Gray3, the determiner 63 can output the second charge share signal CS2 with the low level. The third reference gray level Gray3 can be the same as the first reference gray level Gray1. For example, the third reference gray level Gray3 can become the gray level 191.

In this way, the average gray level of the previous video data R'G'B' can be calculated and compared with the reference gray levels Gray3, in order to determine whether it is or not necessary for the charge share operation in accordance with the previous video data. Therefore, power consumption of the LCD device can be reduced and heat generated in the data driver 30 can be minimized.

Step S130 may similarly be performed on the odd-numbered digital pixel signals of the previous video data R'G'B' S120 to determine whether the determiner 63 may output the first charge share signal CS1 with the high level when the number of even-numbered digital pixel signals of the previous video data R'G'B' have differences of a reference gray level when compared with those of the present video data RGB.

Figure 7:
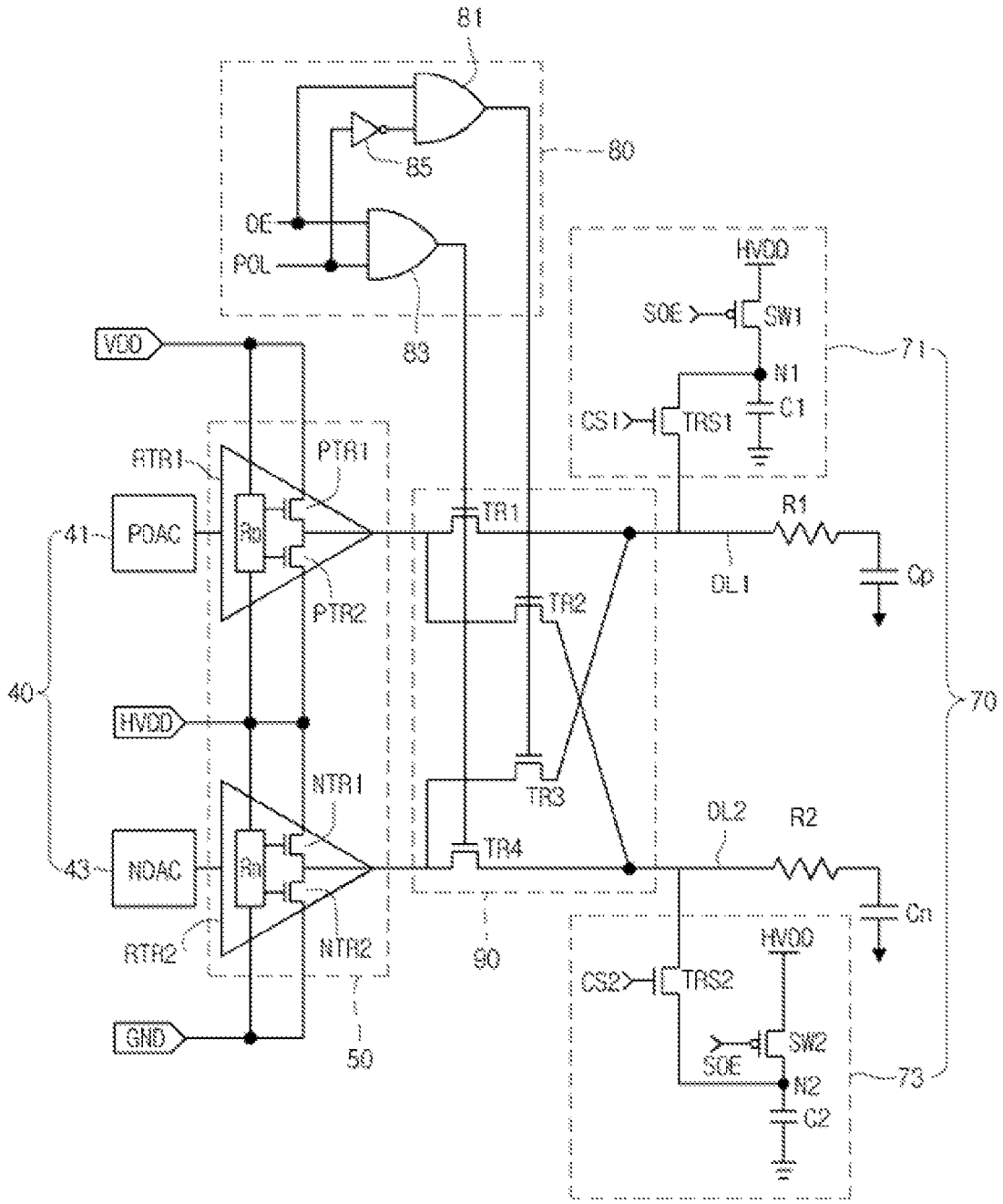
FIG. 7 is a detailed circuit diagram showing a part of the data driver, which includes a charge sharer and is shown in FIG. 2.

FIG. 7 is a detailed circuit diagram showing a part of the data driver, which includes a charge sharer and is shown in FIG. 2.

FIG. 7 shows the DAC 40 and the charge sharer 70 commonly coupled to the first and second data lines DL1 and DL2, as an example.

Referring to FIG. 7, the data driver 30 of the LCD device according to the present embodiment can include the DAC 40 and the buffer portion 50.

The DAC 40 can include a positive polarity PDAC 41 and a negative polarity NDAC 43. The buffer portion 50 can include a positive polarity buffer RTR1 and a negative polarity buffer RTR2. The positive polarity DAC 41 can applies a positive data voltage to the positive polarity buffer RTR1. The negative polarity DAC 43 can applies a negative data voltage to the negative polarity buffer RTR2.

The positive polarity buffer RTR1 and the negative polarity buffer RTR2 can each have a rail-to-rail configuration. The positive polarity buffer RTR1 can include a positive polarity logic circuit Rp and first and second positive polarity transistors PTR1 and PTR2. The negative polarity buffer RTR2 can include a negative polarity logic circuit Rn and first and second negative polarity transistors NTR1 and NTR2.

The positive polarity logic circuit Rp can be coupled between a supply voltage line VDD and a bias voltage line HVDD. The negative polarity logic circuit Rn can be coupled between the bias voltage line HVDD and a ground voltage line GND. The bias voltage HVDD can be set to have a middle vale of the supply voltage VDD. Also, the bias voltage HVDD can be set to a reference voltage corresponding to a gray level 0. The positive and negative polarity buffers RTR1 and RTR2 with the rail-to-rail configuration enable the positive and negative polarity logic circuits Rp, Rn to be serially coupled between the supply voltage line VDD and the ground voltage line GND, unlike those with the single ended configuration. As such, a driving current may be enabled to flow from the supply voltage line VDD to the ground voltage line GND via the bias voltage line HVDD. In accordance therewith, power consumption of the buffer portion 50 can be reduced. The positive polarity logic circuit Rp can be used to drive the positive polarity buffer RTR1, and the negative polarity logic circuit Rn can be used to drive the negative polarity buffer RTR2.

The positive and negative data voltages output from the buffer portion 50 can be applied to the first and second data lines DL1 and DL2 by means of a switch portion 90. The positive and negative data voltages transferred from the buffer portion 50 to the first and second data lines DL1 and DL2 are described, but it is only an example. As such, the positive and negative data voltages output from the buffer 50 can be applied to the odd-numbered and even-numbered data lines.

The switch portion 90 can be turned-on/off under the control of a switch controller 80. The switch controller 80 can control the turning-on/off operation of the switch portion 90 on the basis of the data enable signal DE and the polarity signal POL which are applied from the timing controller 10. The switch portion 90 may include first through fourth transistors TR1~TR4. The switch controller 80 may be configured with two AND-gates 81 and 83 and a single inverter 85 as shown. Other embodiments may include different gates providing functional output for configuring the switching portion 90 (e.g., providing gate voltages to the first through fourth transistor TR1~TR4 switches).

The switch controller 80 may turn-on the switch portion 90 only when the data enable signal DE has the high level. In other words, the data voltages may be applied to the first and second data lines DL1 and DL2 only when the data enable signal DE has the high level.

If the data enable signal DE has the high level and the polarity signal POL has the high level, the first and fourth transistors TR1 and TR4 are turned-on. As such, the positive data voltage output from the positive polarity buffer RTR1 can be applied to the first data line DL1, and the negative data voltage output from the negative polarity buffer RTR2 can be applied to the second data line DL2.

Meanwhile, when the data enable signal DE has the high level but the polarity signal POL has the low level, the second and third transistors TR2 and TR3 are turned-on. As such, the positive data voltage output from the positive polarity buffer RTR1 can be applied to the second data line DL2, and the negative data voltage output from the negative polarity buffer RTR2 can be applied to the first data line DL1.

A first resistor R1 and a first capacitor Cp correspond to an equivalent resistance and an equivalent capacitance of plural pixel regions which are connected to the first data line DL1. A second resistor R2 and a second capacitor Cn correspond to an equivalent resistance and an equivalent capacitance of plural pixel regions which are connected to the second data line DL2.

The charge sharer 70 may include a positive charge sharer 71 and a negative charge sharer 73. The positive charge sharer 71 can perform the charge share operation for the first data line DL1. The negative charge sharer 73 can perform the charge share operation for the second data line DL2. Although FIG. 7 shows that the positive and negative charge sharers 71, 73 perform the charge share operation for the first and second data lines DL1, DL2, it is only an example. As such, the positive charge sharer 71 may perform the charge share operation for an odd-numbered data line, and the negative charge sharer 73 may perform the charge share operation for an even-numbered data line.

The positive charge sharer 71 may include a first switch element SW1, a first charge share switch element TRS1 and a first charge capacitor C1.

The first switch element SW1 and the first charge capacitor C1 may be serially coupled between the bias voltage line HVDD and the ground voltage line GND.

The first switch element SW1 may be a thin film transistor. A gate electrode of the first switch element SW1 may receive, as input, the source output enable signal SOE. A source electrode of the first switch element SW1 receives the bias voltage HVDD and a drain electrode of the first switch element SW1 may be coupled to a first node N1 corresponding to a first terminal of the first charge capacitor C1 and/or the first charge share switch element TRS1.

The first terminal of the first charge capacitor C1 can be coupled to the first node N1. A second terminal of the first charge capacitor C1 may be connected to the ground voltage line GND. As such, the bias voltage HVDD can be charged into the first charge capacitor C1 by activating the first switch element SW1 in response to the source output enable signal SOE.

The first charge share switch element TRS1 may be a thin film transistor. The first charge share switch element TRS1 can be turned-on/off in response to the first charge share signal CS1 in order to couple the first data line DL1 with the first node N1.

The negative charge sharer 73 may include a second switch element SW2, a second charge share switch element TRS2 and a second charge capacitor C2.

The second switch element SW2 and the second charge capacitor C2 may be serially coupled between the bias voltage line HVDD and the ground voltage line GND.

The second switch element SW2 may be a thin film transistor. A gate electrode of the second switch element SW2 may receive, as input, the source output enable signal SOE. A source electrode of the second switch element SW2 receives the bias voltage HVDD. A drain electrode of the second switch element SW2 may be coupled to to a second node N2 corresponding to a first terminal of the second charge capacitor C2 and/or the second charge share switch element TRS2.

The first terminal of the second charge capacitor C2 can be coupled to the second node N2. A second terminal of the second charge capacitor C2 may be connected to the ground voltage line GND. As such, the bias voltage HVDD can be charged into the second charge capacitor C2 by activating the second switch element SW2 in response to the source output enable signal SOE.

The second charge share switch element TRS2 maybe a thin film transistor. The second charge share switch element TRS2 can be turned-on/off in response to the second charge share signal CS2 in order to couple the second data line DL2 with the second node N2.

Figure 8A:
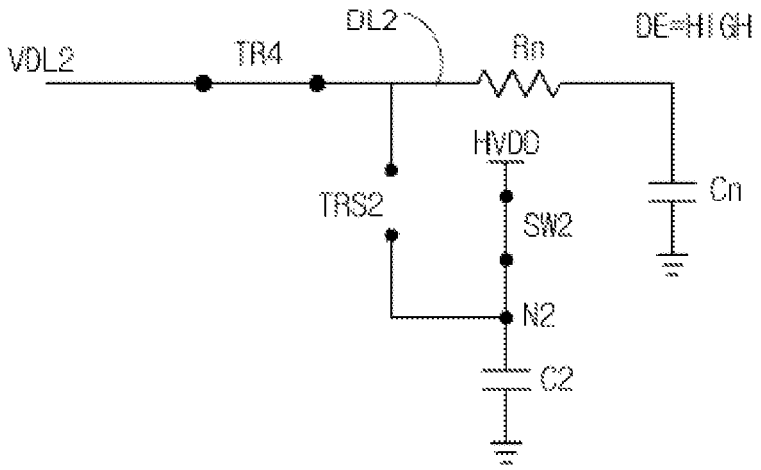
FIGS. 8A through 8C are circuit diagrams showing operation states of the charge sharer of FIG. 7.
Figure 8B:
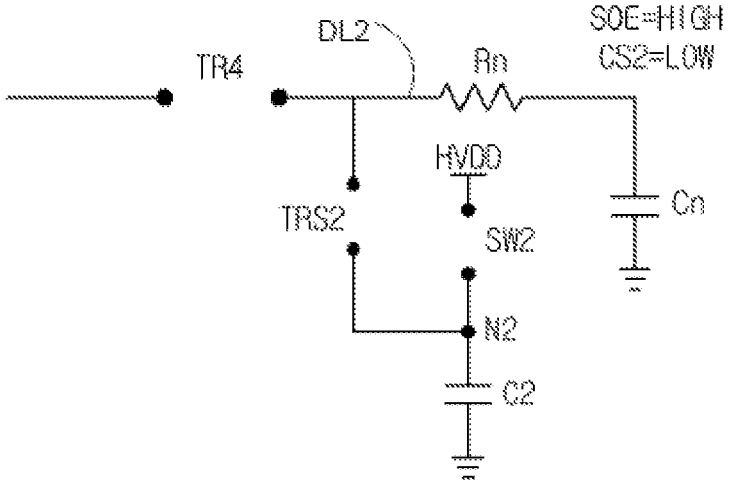
Figure 8C:
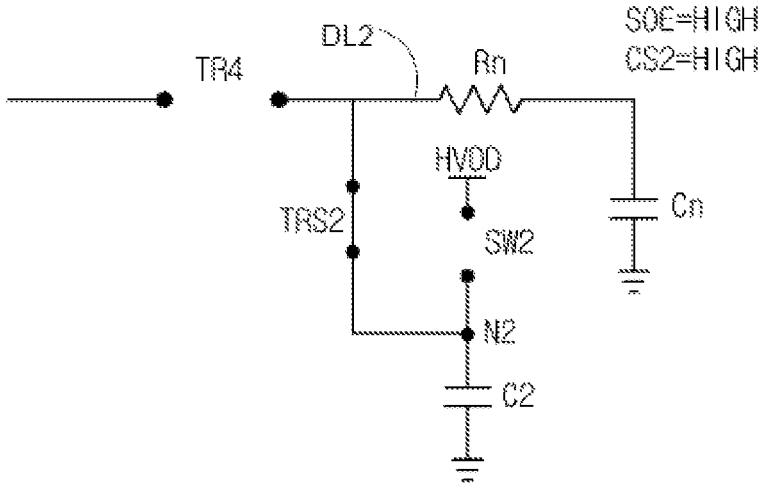

FIGS. 8A through 8C are circuit diagrams showing operation states of the charge sharer 70 of FIG. 7.

Figure 9A:
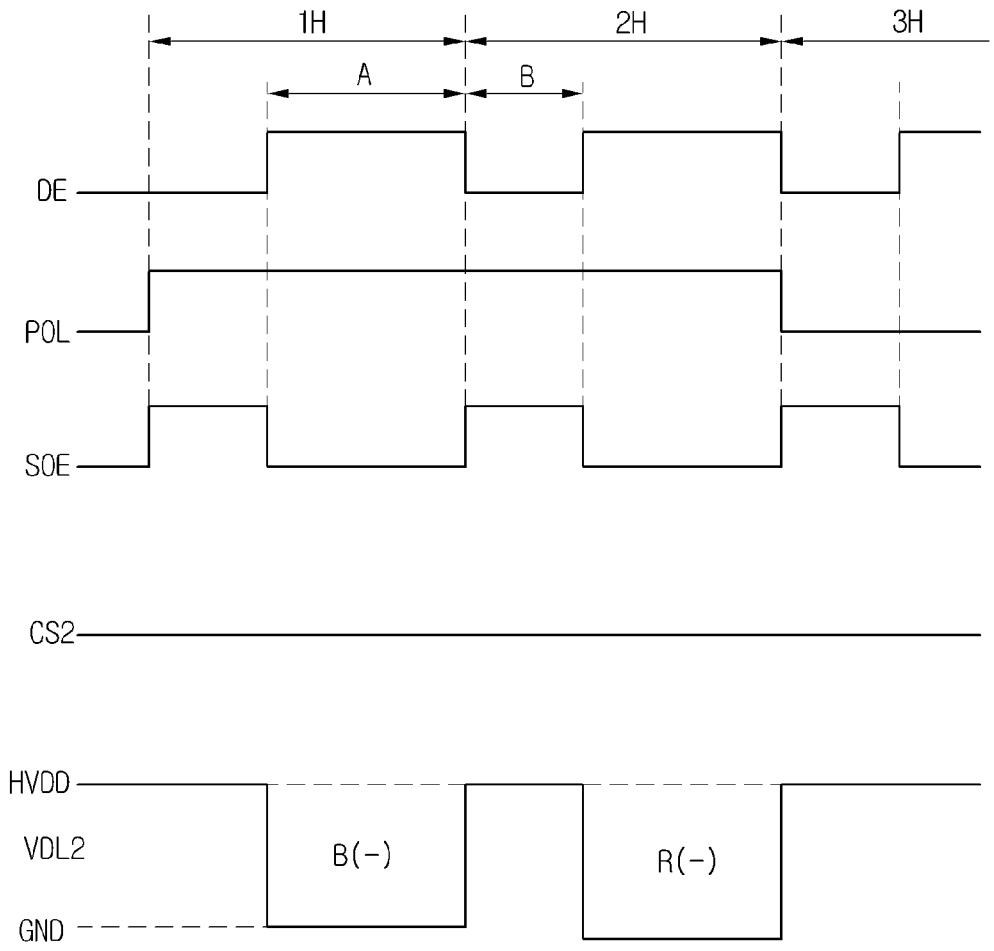
FIGS. 9A and 9B are waveform diagrams illustrating a data voltage which is controlled by a charge sharer of FIG. 7.
Figure 9B:
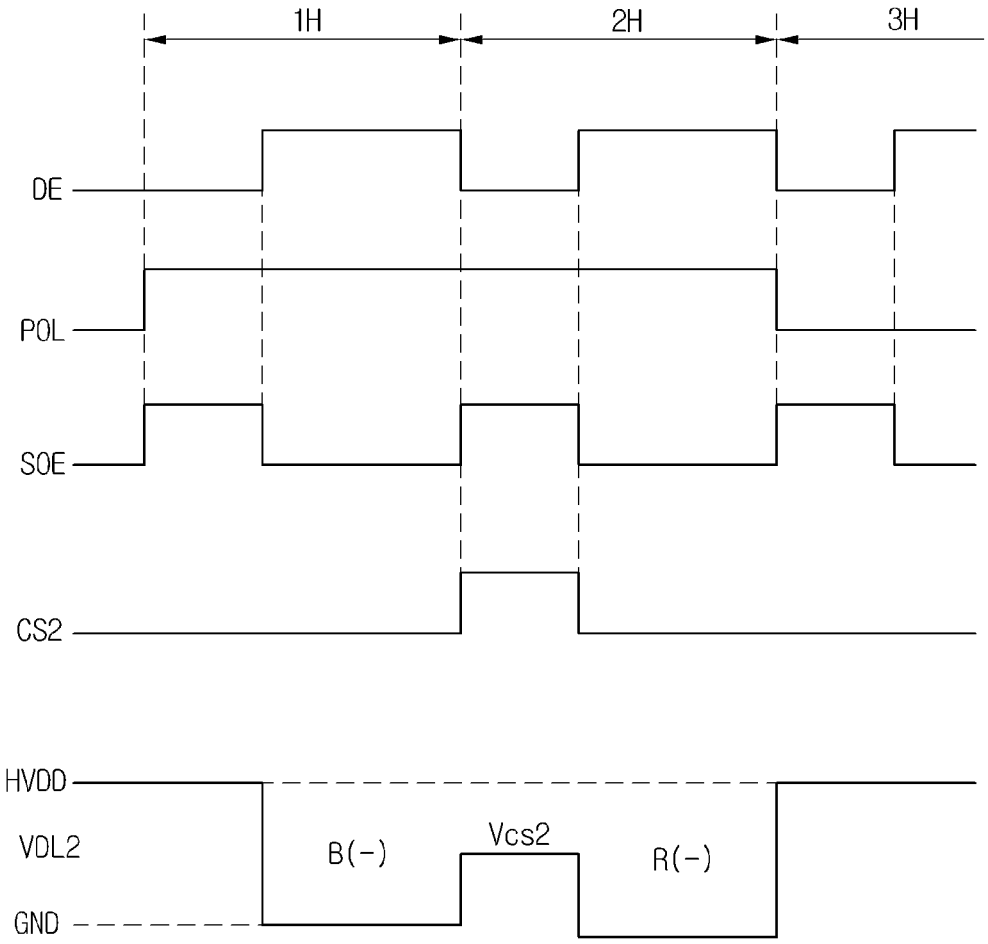

FIGS. 9A and 9B are waveform diagrams illustrating a voltage variation of a data line which is controlled by a charge sharer of FIG. 7.

The negative charge sharer 73 and the charge share operation for the second data line DL2 performed thereby will now be described referring to FIGS. 8 and 9. The positive charge sharer 71 and the charge share operation for the first data line DL1 performed thereby functions in a similar manner. Hence, the positive charge sharer 71 and the charge share operation for the first data line DL1 will be omitted for brevity.

FIG. 8A is a circuit diagram showing the operation state of the negative charge sharer 73 when the data voltage VDL2 is applied to the second data line DL2. An interval A of FIG. 9B shows the corresponding states of input and output signals of the data driver 30 which are used to apply the data voltage to the second data line DL2.

Referring to FIG. 8A and the interval A of FIG. 9A, the data enable signal DE and the source output enable signal SOE can have complementary logic levels during a single horizontal interval. The polarity signal POL can maintain the high level during first and second horizontal intervals H1 and H2, in order to drive the LCD panel 1 according to the DRD mode as shown in FIG. 3. In the interval A, the data enable signal DE has the high level but the source output enable signal SOE has the low level.

The data enable signal DE with the high level can allow the fourth transistor TR4 to be turned-on. As such, the negative data voltage VDL2 can be applied via the second data line DL2 to a pixel region coupled to the second data line DL2. Meanwhile, the second charge share switch element TRS2 can be turned-off because the second charge share signal CS2 has the low level. In accordance therewith, the second node N2 is not connected to the second data line DL2. In other words, the charge share operation cannot be performed because the negative charge sharer 73 is disconnected from the second data line DL2, while the negative data voltage VDL2 is applied to the second data line DL2.

In the same time, the second switch element SW2 can be turned-on by the source output enable signal SOE with the low level (i.e., turns-on for compliment of the source output enable signal SOE) and allow the bias voltage HVDD to be charged into the second charge capacitor C2 via the second node N2. In other words, the bias voltage HVDD can be charged into the second charge capacitor C2 in the interval A when the negative data voltage VDL2 is applied to the second data line DL2.

FIG. 8B is a circuit diagram showing the operation state of the negative charge sharer 73 when the charge share operation is not performed. An interval B of FIG. 9A shows the states of input and output signals of the data driver 30 when the charge share operation is not performed.

Referring to FIG. 8B and an interval B of FIG. 9A, the data enable signal DE has the low level and the source output enable signal SOE has the high level, thus the fourth transistor TR4 and the second switch element SW2 are off.

The second charge share signal CS2 generated in the charge share controller 60 has the low level. As such, the second charge share switch element TRS2 is turned-off. Also, the second switch element SW2 is turned-off by the source output enable signal SOE with the high level. Moreover, the fourth transistor TR4 is turned-off by the data enable signal DE with the low level. In accordance therewith, the negative charge sharer 73 is disconnected from the second data line DL2, and the charge share operation is not performed.

FIG. 8C is a circuit diagram showing the operation state of the negative charge sharer 73 when the charge share operation is performed. FIG. 9B is a waveform diagram showing input and output signals of the data driver 30 when the charge share operation is performed.

Referring to FIGS. 8C and 9B, the charge share controller 60 generates the second charge share signal CS2 of the high level which is synchronized with the source output enable signal SOE. The charge share signal CS2 with the high level enables the second charge share switch element TRS2 to be turned-on so that the second node N2 is coupled to the second data line DL2. Meanwhile, the second switch element SW2 is turned-off by the source output enable signal SOE with the high level, and the fourth transistor TR4 is turned-off by the data enable signal DE with the low level.

As such, the bias voltage HVDD charged in the second charge capacitor C2 can be applied to the second data line DL2. In other words, the charge share operation can be performed for the second data line DL2. In accordance therewith, the second data line DL2 can be charged with a second charge voltage VCS2 corresponding to a middle value of the bias voltage HVDD and a blue data voltage 'B' which had been applied to the second data line DL2 during the previous horizontal interval (i.e., the first horizontal interval H1). The second charge share voltage VCS2 can allow power consumption due to the data voltage to be reduced. As a result, power consumption of the LCD device can be reduced, and heat generated in the data driver 30 can be minimized. In other words, the electric charges charged into the second charge capacitor C2 can be used in the charge share operation which allows the second data line DL2 to be charged with the middle level. As such, power consumption of the LCD device can be reduced.

Also, the LCD device can use the bias voltage, which corresponds to a reference voltage of gray level 0, for the charge share operation. Therefore, the LCD device can simplify the circuit configuration and reduce manufacturing costs, unlike that of the related art requiring additional voltages.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display device comprising:

a liquid crystal display panel including a plurality of gate lines and a plurality of data lines;

a data driver configured to apply data voltages to the data lines;

a gate driver configured to apply gate pulses to the gate lines; and a charge share device configured to selectively perform a charge share operation, the charge share device comprising:

a line memory configured to store first video data from a first interval, the first video data comprising a first entire gray level of a first data line during the first interval and a second entire gray level of a second data line during the first interval;

a determiner configured to:

receive second video data from a second interval, the second video data comprising a third entire gray level of the first data line during the second interval and a fourth entire gray level of the second data line during the second interval;

determine at least two differences between entire gray levels of the first video data and entire gray levels of the second video data, the differences comprising a first difference between the first entire gray level and the third entire gray level and a second difference between the second entire gray level and the fourth entire gray level, detect a number of the at least two differences that are not less than a first non-zero reference gray level, and output a charge share signal in response to the detected number of the at least two differences that are not less than the first non-zero reference gray level; and one or more charge sharers configured to:

store charges corresponding to a bias voltage in response to the first video data during the first interval, and provide, in response to the charge share signal, the stored charges to even or odd-numbered data lines in response to the second video data during the second interval.

2. The liquid crystal display device of claim 1, wherein the one or more charge sharers comprise:

a positive charge sharer configured to perform the charge share operation for the odd-numbered data lines; and a negative charge sharer configured to perform the charge share operation for the even-numbered data lines.

3. The liquid crystal display device of claim 2, wherein the positive charge sharer and the negative charge sharer each include a charge capacitor to store the charges, and the charge share operation is performed using the bias voltage charged in the charge capacitor.

4. The liquid crystal display device of claim 3, wherein the charge capacitor is charged with the bias voltage while the data voltages are applied to the data lines, and the charge share operation is performed while the data voltages are not applied to the data lines.

5. The liquid crystal display device of claim 3, wherein the bias voltage is a reference voltage corresponding to a gray level 0.

6. The liquid crystal display device of claim 2, wherein the determiner generates:

a first charge share signal used to control the positive charge sharer; and a second charge share signal used to control the negative charge sharer.

7. The liquid crystal display device of claim 1, wherein the determiner calculates an average gray level of the first video data and determines whether to perform the charge share operation on the basis of the average gray level of the first video data if the detected number is not more than a reference value.

8. The liquid crystal display device of claim 7, wherein the reference value is a second reference gray level, and the determiner determines whether to perform the charge share operation based on the average gray level of the first video data being not more than the second reference gray level in response to the detected number corresponding to 2.

9. The liquid crystal display device of claim 8, wherein the second reference gray level is between a maximum gray level and the first non-zero reference gray level.

10. The liquid crystal display device of claim 7, wherein the reference value is a third reference gray level, and the determiner determines whether to perform the charge share operation based on the average gray level of the first video data being not more than the third reference gray level in response to the detected number corresponding to 1.

11. The liquid crystal display device of claim 10, wherein the first non-zero reference gray level and third reference gray level are substantially the same.

12. The liquid crystal display device of claim 1, wherein the data driver includes:

a digital-to-analog converter configured to convert video data into the data voltages;

a positive polarity buffer outputting positive data voltages from the digital-to-analog converter to the data lines, the positive polarity buffer including a positive polarity logic circuit; and a negative polarity buffer outputting negative data voltages from the digital-to-analog converter to the data lines, the negative polarity buffer including a negative polarity logic circuit, the positive polarity logic circuit and the negative polarity logic circuit being coupled in series between a supply voltage line and a ground voltage line.

13. The liquid crystal display device of claim 1, wherein the liquid crystal display panel is driven in a double rate driving mode.

14. A method of driving a liquid crystal display device including a plurality of gate lines and a plurality of data lines, the method comprising:

storing charges corresponding to a bias voltage while applying a data voltage to one of the data lines during a first interval;

storing first video data from a first interval, the first video data comprising a first entire gray level of a first data line during the first interval and a second entire gray level of a second data line during the first interval;

receiving second video data from a second interval, the second video data comprising a third entire gray level of the first data line during the second interval and a fourth entire gray level of the second data line during the second interval;

determining at least two differences between entire gray levels of the first video data and entire gray levels of the second video data, the differences comprising a first difference between the first entire gray level and the third entire gray level and a second difference between the second entire gray level and the fourth entire gray level;

detecting a number of the at least two differences that are at least a first non-zero reference gray level; and determining whether to perform a charge share operation based at least in part on the detected number exceeding a threshold value, the charge share operation performed by providing the stored charges to said one or another one of the data lines during the second interval.

15. The method of claim 14, further comprising outputting a charge share signal when the detected number equals a total number of the at least two differences.

16. The method of claim 14, further comprising comparing an average gray level of the first video data with a second reference gray level when the detected number corresponds to 1.

17. The method of claim 16, further comprising outputting a charge share signal when the average gray level of the first video data is not more than the second reference gray level.

18. The method of claim 16, wherein the first and second reference gray levels are substantially the same.

19. The method of claim 14, further comprising comparing an average gray level of the first video data with a third reference gray level when the detected number corresponds to 2.

20. The method of claim 19, further comprising outputting a charge share signal when the average gray level of the first video data is not more than the third reference gray level.

21. The method of claim 19, wherein the third reference gray level is between a maximum gray level and the first non-zero reference gray level.

22. The method of claim 14, wherein the first non-zero reference gray level corresponds to a middle gray level.

* * * * *